US010746081B2

(12) United States Patent
Mellencamp

(10) Patent No.: US 10,746,081 B2
(45) Date of Patent: Aug. 18, 2020

(54) EXHAUST COMPONENT ENCLOSURE SYSTEM

(71) Applicant: Caterpillar Inc., Deerfield, IL (US)

(72) Inventor: Keith W. Mellencamp, Greencastle, IN (US)

(73) Assignee: Caterpillar Inc., Peoria, IL (US)

( * ) Notice: Subject to any disclaimer, the term of this patent is extended or adjusted under 35 U.S.C. 154(b) by 32 days.

(21) Appl. No.: 16/103,189

(22) Filed: Aug. 14, 2018

(65) Prior Publication Data

US 2020/0056530 A1 Feb. 20, 2020

(51) Int. Cl.
*F01N 13/10* (2010.01)
*F01N 13/14* (2010.01)

(52) U.S. Cl.
CPC ..... *F01N 13/102* (2013.01); *F01N 13/143* (2013.01)

(58) Field of Classification Search
CPC combination set(s) only.
See application file for complete search history.

(56) References Cited

U.S. PATENT DOCUMENTS 4,182,122 A 1/1980 Stratton et al.
5,615,711 A * 4/1997 Lewis ..... F01N 13/08 138/110
5,974,784 A * 11/1999 Feldman ..... B01D 53/94 165/185
7,713,492 B2 * 5/2010 Maus ..... F01N 3/2828 422/179
8,608,237 B2 * 12/2013 Hwang ..... B60R 13/0876 296/193.07
8,631,895 B2 * 1/2014 Tanaka ..... F16L 9/19 180/309
9,194,513 B2 * 11/2015 Sierra ..... F01N 1/24
2007/0163250 A1 * 7/2007 Sane ..... F01N 3/20 60/323

FOREIGN PATENT DOCUMENTS

EP 1862651 B1 12/2007
KR 101385414 B1 4/2014
WO WO 2017/85353 A1 5/2017

* cited by examiner

*Primary Examiner* — Binh Q Tran
(74) *Attorney, Agent, or Firm* — Bookoff McAndrews PLLC

(57) ABSTRACT

An exhaust enclosure system may include an inner insulation assembly circumferentially surrounding an outlet pipe of an engine exhaust manifold. The inner insulation assembly may be in direct contact with the exhaust manifold. The exhaust enclosure system may include a cover enclosing the inner insulation assembly. The cover may be physically separated from the inner insulation assembly by a circumferential air gap disposed between the inner insulation assembly and the cover.

22 Claims, 3 Drawing Sheets

EXHAUST COMPONENT ENCLOSURE SYSTEM

TECHNICAL FIELD

The present disclosure relates generally to thermal enclosure systems, and more particularly, to exhaust enclosure systems for internal combustion engines.

BACKGROUND

Internal combustion engines generate significant heat which is transferred by exhaust gases to the exhaust components, e.g., the exhaust manifold, of the engine. Thermally isolating the exhaust components may protect other components of the engine and nearby machinery from excessive heat and improve safety for operators. Thermal isolation of engine exhaust components may also be required in order to comply with regulations. For example, marine engines must meet surface temperature limits associated with the International Convention for the Safety of Life at Sea (SOLAS). A few types of exhaust enclosures systems have been implemented to thermally isolate exhaust components of internal combustion engines.

Some exhaust enclosure systems isolate engine exhaust components with semi-flexible insulation material to limit the surface temperatures of the exhaust components. Although these semi-flexible systems may reduce the outer surface temperature, these coverings may not properly insulate all exhaust components. For example, forming the semi-flexible material around joints of the exhaust manifold may result in gaps between sections of semi-flexible insulation material. Additionally, depending on the type of semi-flexible material and the manner in which it is applied, removing the semi-flexible material for service or maintenance may prove difficult.

Other exhaust enclosure systems may thermally isolate exhaust components using liquid cooling. These liquid cooled exhaust enclosures may be relatively expensive and difficult to perform maintenance upon. Additionally, liquid cooled exhaust enclosures may require altering the cooling system of the engine to supply coolant to the exhaust enclosure.

One example of a heat insulation structure for an exhaust system is disclosed in International Patent Application Publication No. WO 2017/085353 A1 published to Wärtsilä Finland Oy on May 26, 2017 ("the '353 publication"). While the heat insulation structure of the '353 publication may be useful in certain applications, thermal isolation of the exhaust components and ease of serviceability, may be improved.

The exhaust enclosure system of the present disclosure may solve one or more of the problems set forth above and/or other problems in the art. The current scope of the disclosure, however, is defined by the attached claims and not by the ability to solve any specific problem.

SUMMARY OF THE DISCLOSURE

According to one aspect of the present disclosure, an exhaust enclosure system may include an inner insulation assembly circumferentially surrounding an outlet pipe of an engine exhaust manifold. The inner insulation assembly may be in direct contact with the exhaust manifold. A cover may enclose the inner insulation assembly. The cover may be physically separated from the inner insulation assembly by a circumferential air gap disposed between the inner insulation assembly and the cover.

According to another aspect of the present disclosure, an exhaust enclosure system, comprising: an inner insulation assembly circumferentially surrounding an outlet pipe of an engine exhaust manifold, the inner insulation assembly including: a first layer circumferentially surrounding the outlet pipe, the first layer including a plurality of wear portions in direct contact with the outlet pipe, a second layer circumferentially surrounding the first layer, and a third layer circumferentially surrounding the second layer, wherein the second layer is different and thicker than the first and third layers, and the second layer includes insulating material; a cover enclosing the inner insulation assembly; and an air gap circumferentially between the cover and the inner insulation assembly According to yet another aspect of the present disclosure, an exhaust enclosure system may include an inner insulation assembly circumferentially surrounding an outlet pipe of an engine exhaust manifold. The inner insulation assembly may include a plurality of modules. Each module may include a first layer in direct contact with an exhaust manifold, and a second layer fixed to the first layer and having different insulation properties than the first layer. The exhaust enclosure system may include a cover enclosing the plurality of modules of the inner insulation assembly. The cover may include a plurality of individual cover segments. The exhaust enclosure may include an air gap positioned between the plurality of modules of the inner insulation assembly and the cover segments.

BRIEF DESCRIPTION OF THE DRAWINGS

The accompanying drawings, which are incorporated in and constitute a part of this specification, illustrate various exemplary embodiments and together with the description, serve to explain the principles of the disclosed embodiments.

DETAILED DESCRIPTION

Both the foregoing general description and the following detailed description are exemplary and explanatory only and are not restrictive of the features, as claimed. As used herein, the terms "comprises," "comprising," "having," "including," or other variations thereof, are intended to cover a non-exclusive inclusion such that a process, method, article, or apparatus that comprises a list of elements does not include only those elements, but may include other elements not expressly listed or inherent to such a process, method, article, or apparatus. In this disclosure, relative terms, such as, for example, "about," "substantially," "generally," and "approximately" are used to indicate a possible variation of ±10% in a stated value or characteristic.

Figure 1:
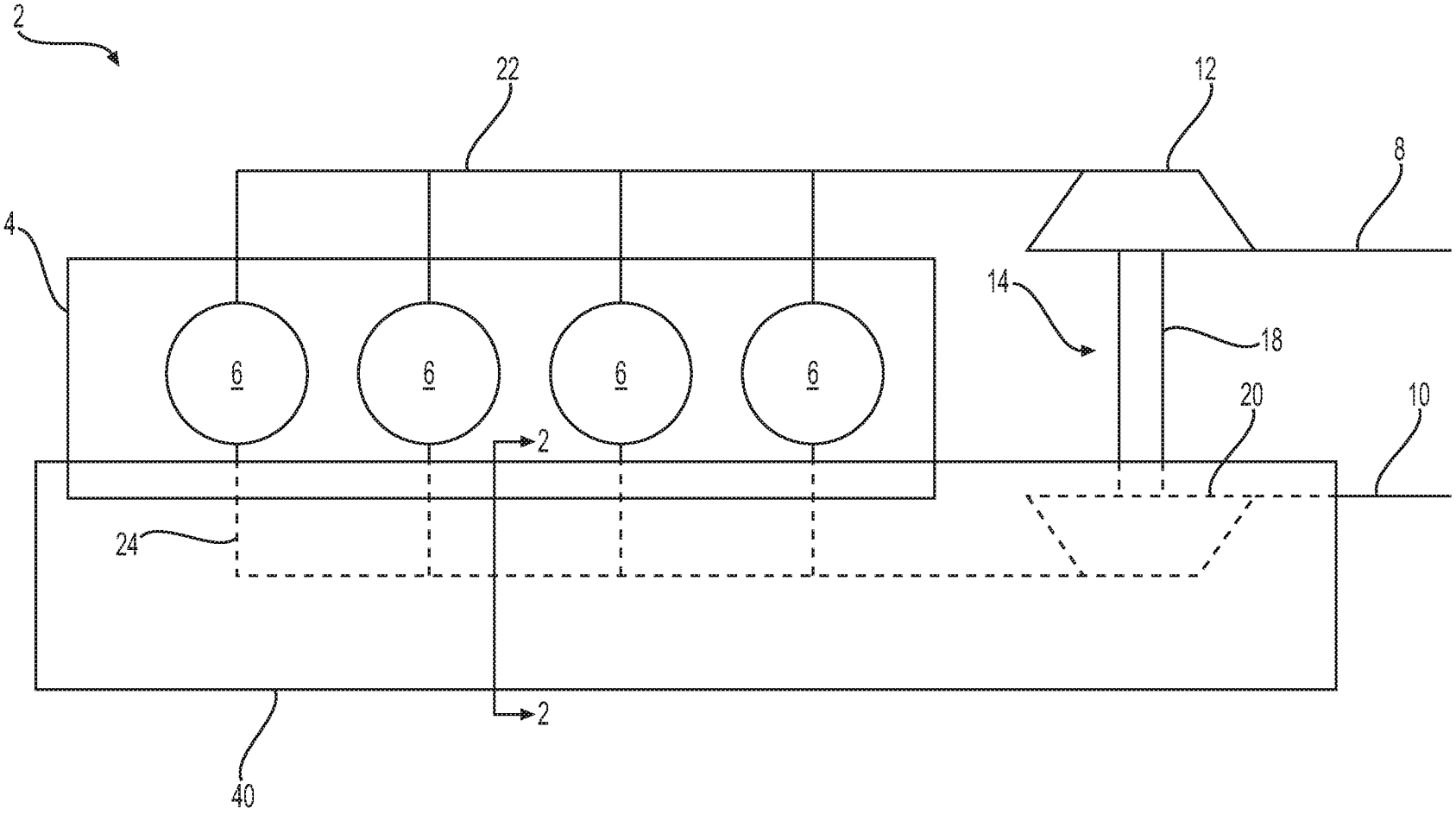
FIG. 1 is a schematic illustration of an engine having an exhaust enclosure system according to aspects of the present disclosure.

FIG. 1 illustrates a schematic view of an exemplary internal combustion engine 2 including an engine block 4 defining a plurality of engine cylinders 6. While the illustrated embodiment is that of an in-line four cylinder engine, this is only exemplary. In general, the current disclosure can be applied to any type of internal combustion engine 2 with any known configuration (e.g., radial, V, etc.) or number of engine cylinders 6 (e.g., 6, 8, 12, 20, etc.).

The engine 2 may include a turbocharger 14. In some examples, the engine 2 may be naturally aspirated, or include multiple turbochargers. Exhaust gases produced from combustion in the plurality of engine cylinders 6 may be directed through an exhaust manifold 24, e.g., via an outlet pipe of the exhaust manifold, to a turbine 20 of the turbocharger 14. The turbine 20 may be mechanically coupled to a compressor 12, e.g., via a shaft 18. As exhaust gases move through the turbine 20, the turbine 20 may rotate and drive the compressor 12 to compress air received from an intake line 8. An intake manifold 22 fluidly coupled to each of the plurality of engine cylinders 6, may guide the compressed air from the compressor 12 into the plurality of engine cylinders 6 for combustion. Exhaust gases passed through the turbine 20 may flow through an outlet line 10. It is contemplated that the outlet line 10 may direct exhaust gases to an after-treatment system (not shown) before the exhaust gases are released to the atmosphere.

As shown in FIG. 1, exhaust components, including but not limited to, the exhaust manifold 24 and turbine 20 may be housed within an exhaust system enclosure 40. The exhaust enclosure system 40 may extend along the exhaust manifold 24 from the plurality of engine cylinders 6 to the turbine 20, e.g., along the an outlet pipe of the exhaust manifold 24. The exhaust enclosure system 40 may extend over the turbine 20. The exhaust enclosure system 40 may enclose additional exhaust components, such as, e.g., coolers, EGR systems, or catalytic converters. The exhaust enclosure system 40 may be coupled to the engine block 4. In at least one example, the exhaust enclosure system 40 may cover part of the engine block 4. The exhaust enclosure system 40 may at least partially thermally isolate exhaust components of the engine 2, e.g., the exhaust manifold 24, from other engine 2 components and the area surrounding the exhaust enclosure system 40. The exhaust enclosure system 40 may enclose the exhaust components so that an outer most surface of the exhaust enclosure system 40 is maintained at or below a desired temperature during operation of the engine 2.

Figure 2:
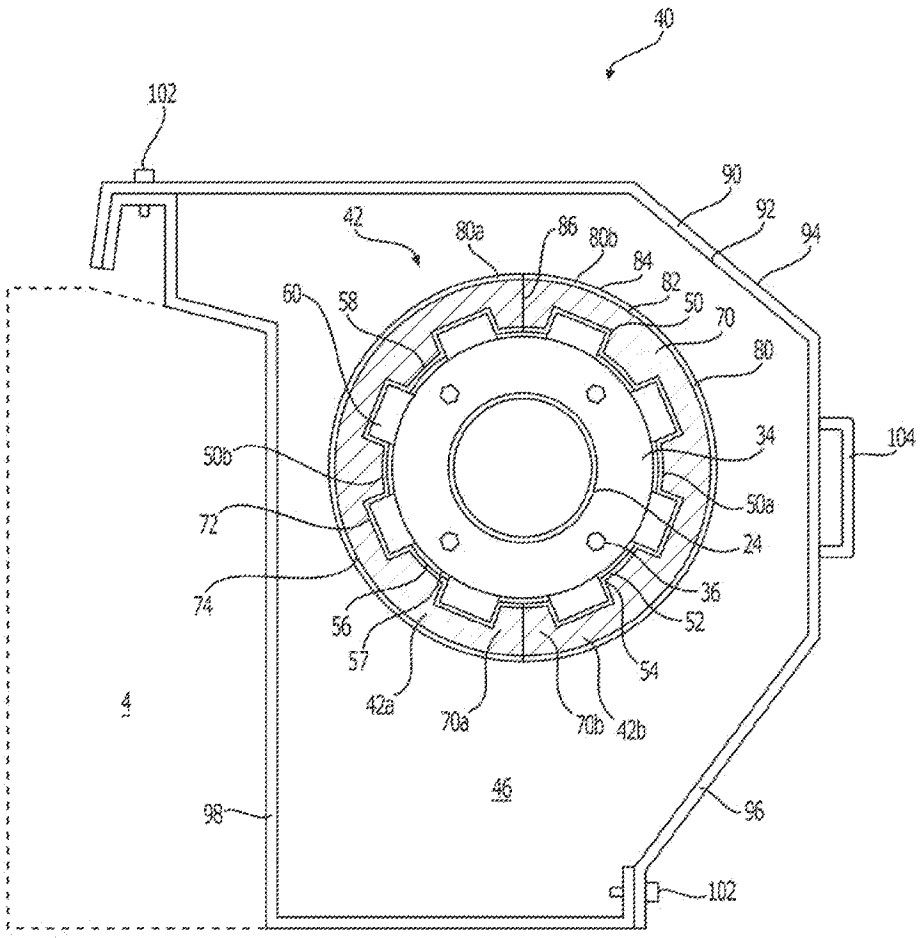
FIG. 2 is a cross-sectional view of the exhaust enclosure system of FIG. 1.

FIG. 2 shows a cross-sectional view of the exhaust manifold 24 positioned within the exhaust enclosure system 40. The exhaust manifold 24 may be a tubular structure. In alternative embodiments, the exhaust manifold 24 may have a different cross-sectional shape, e.g., ellipsoidal or rectangular. According to some aspects of the present disclosure, the exhaust manifold 24 may include multiple tubular segments attached end-to-end. The segments may be axially aligned, e.g., along a length of the exhaust manifold 24. Segments of the exhaust manifold may include a radial flange 34 at each end. One exhaust manifold segment may be secured to another via one or more fasteners 36, e.g., bolts, passing through the respective flange 34 of each segment. Additionally or alternatively, exhaust manifold 24 segments may be coupled together using adhesive or welding.

The exhaust enclosure system 40 may include an inner insulation assembly 42 and a cover 90, each circumferentially surrounding the exhaust manifold 24. For example, the inner insulation assembly 42 may circumferentially surround the outlet pipe of the exhaust manifold. The inner insulation assembly 42 may include a plurality of layers. In some examples, the plurality of layers of the inner insulation assembly 42 may be concentric, each disposed around the exhaust manifold 24. The layers may be fixed attached or coupled together, or may be separate from one another. For example, the layers may be attached via crimping or welding of the innermost and outermost layers, and/or by applying an adhesive to the layers.

The inner insulation assembly 42 may include a first layer 50 adjacent to, and circumferentially surrounding, the exhaust manifold 24. An inner surface 52 of the first layer 50 may be in direct contact with the exhaust manifold 24. For example the inner surface 52 of first layer 50 may contact the outlet pipe of the exhaust manifold 24 at the periphery of the flanges 34. The first layer 50 may extend along the exhaust manifold 24 from one flange 34 to another flange 34, thus forming an annular cavity around the exhaust manifold 24 between the flanges 34. The first layer 50 may comprise metal foil. For example, the first layer may comprise foil made from stainless steel or metal alloys, including, but not limited to Inconel, and Incoloy. The foil may be stamped or otherwise formed to increase the rigidity and durability of the first layer 50. The first layer 50 may be corrugated so that the first layer 50 includes one or more projections 58 extending radially toward the exhaust manifold 24. Each projection 58 may be evenly spaced circumferentially around the exhaust manifold 24. The first layer 50 may be in direct contact with the exhaust manifold 24 at an end of each projection 58. The portions of the inner insulation assembly 42 circumferentially between the projections 58 may be positioned a distance from the exhaust manifold 24. The projections 58 may extend axially along a portion of the exhaust manifold 24, thereby forming one or more longitudinal channels 60 between the projections 58. For example, the projections 58 may extend along the outlet pipe of the exhaust manifold 24 to form a plurality of circumferential air pockets between the flanges of the outlet pipe. The air pockets created by the first layer 50 may be fluidly connected between the projections 58. In some examples, the channels 60 may have a generally rectangular cross-section. The projections 58 may themselves form wear portions 56 against the flanges 34 of the exhaust manifold 24, or additional material may be added at the end of the projections 58 contacting the periphery of the flanges 34. For example, each of the wear portions 56 may include a separate wear pad 57. The wear pads may be positioned about the wear portions 56 of the first layer 50 and facing the outlet pipe of the exhaust manifold 24. In some examples, the wear pads may be welded to the first layer 50, e.g., at the wear portions 56.

The inner insulation assembly 42 may include a second layer 70 radially outward of the first layer 50. The second layer 70 may circumferentially surround the first layer 50 so that an inner surface 72 of the second layer 70 is in contact with an outer surface 54 of the first layer 50. The second layer 70 may comprise an insulating material. For example, the second layer may comprise silica batting. A thickness of the second layer 70 may be greater than a thickness of the first layer 50 and/or a third layer 80.

The second layer 70 may be disposed between the first layer 50 and the third layer 80. An inner surface 82 of the third layer 80 may be in contact with an outer surface 74 of the second layer 70. The third layer 80 may comprise the same materials as the first layer 50. For example, the third layer 80 may comprise metal foil that may be stamped or otherwise formed.

The inner insulation assembly 42, and each layer thereof, may comprise one or more parts (e.g., 42*a* and 42*b*) assembled circumferentially around the exhaust manifold. For example, the inner insulation assembly may be divided into two circumferential halves. Thus, as shown in FIG. 2, each of the first layer 50, the second layer 70, and the third layer 80 may be divided into halves, 50*a* and 50*b*, 70*a* and 70*b*, and 80*a* and 80*b*, respectively forming the two circumferential parts 42*a* and 42*b*. When assembled, the two halves of each layer may completely circumferentially surround the layer(s) disposed therein. In some examples, one or more of the first layer 50, the second layer 70, and the third layer 80 may include more than two circumferential parts. Additionally or alternatively, at least one of the first layer 50, the second layer 60, and the third layer 70 may include a single circumferential part having a slit or opening configured to receive the exhaust manifold 24. The parts (42*a*, 42*b*) may be arranged to circumferentially abut with an interference 86 between parts. The interference 86 may be seamless, that is, each part within a layer may abut another without any gap or overlap.

Figure 3:
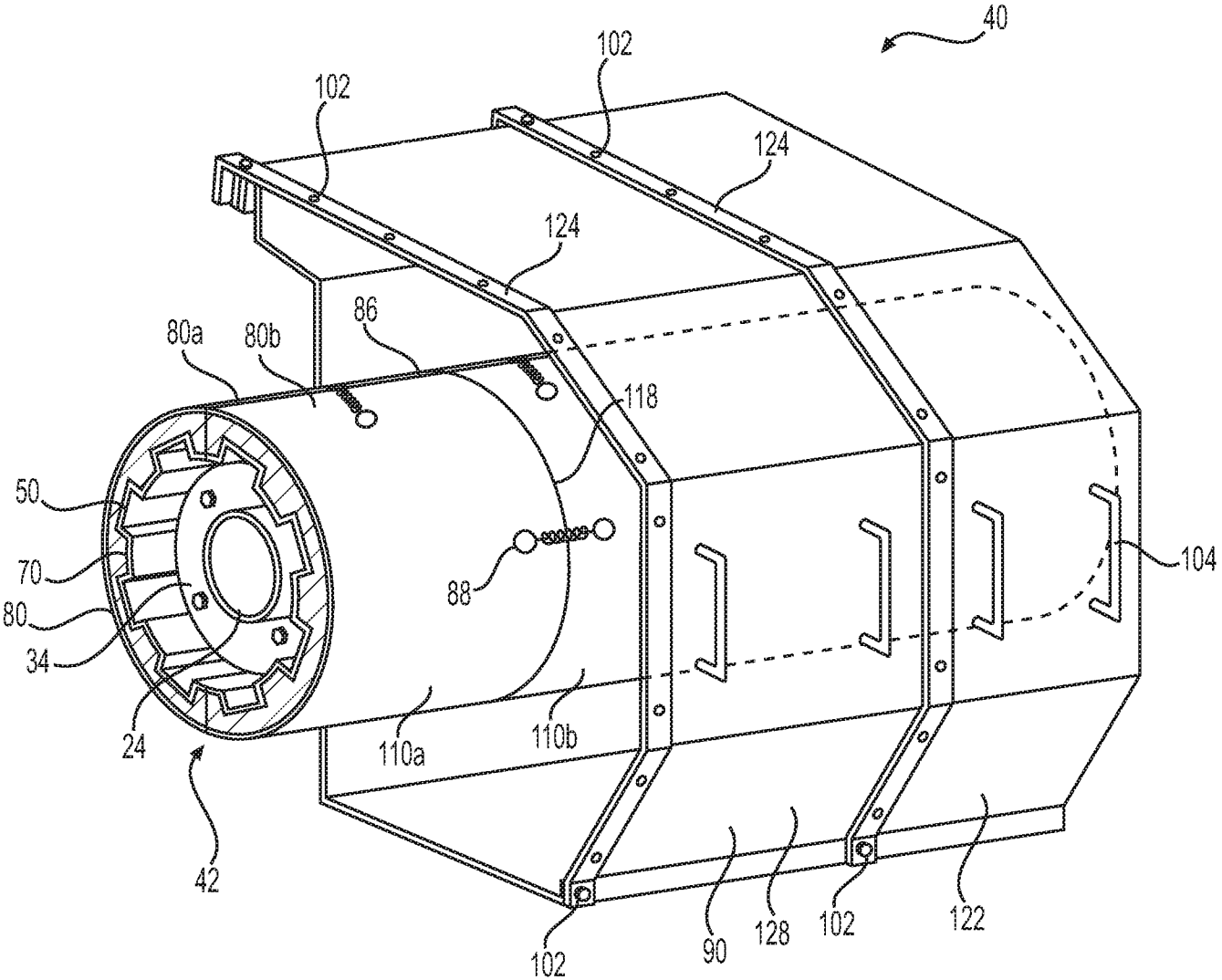
FIG. 3 is a perspective view of exemplary modules of the exhaust enclosure system of FIG. 2.

The circumferential parts (42*a*, 42*b*) may be attached to one another via attachment elements 88, e.g., spring and hook assemblies (shown in FIG. 3). The attachment elements 88 may be affixed to an outer surface 84 of the third layer 80. The attachment elements 88 may pull each part (42*a*, 42*b*) together thereby exerting a force radially inward to secure the inner insulation assembly 42 to the exhaust manifold 24.

Referring back to FIG. 2, the exhaust manifold 24 and the inner insulation assembly 42 may be enclosed within the cover 90. An inner surface 92 of the cover 90 may be spaced a distance from the outer surface 84 of the third layer 80 to form an air gap 46 between the inner insulation assembly 42 and the cover 90. For example, the air gap 46 may circumferentially surround the inner insulation assembly 42 so that the air gap 46 is positioned or disposed between the inner insulation assembly 42 and the cover 90. In some examples, the cover 90 may comprise metal, such as, e.g., carbon steel. The cover 90 may be physically separated from the inner insulation assembly 42 and the exhaust manifold 24. The cover 90 may include one or more panels. A first panel 98 of the cover 90 may be coupled to the engine block 4, between the engine block 4 and the exhaust manifold 24. A second panel 96 may be opposite the first panel 98. The first panel 98 and the second panel 96 may be removably coupled, e.g., via one or more fasteners 102. An operator may use one or more handles 104 attached to an outer surface 94 of the cover 90 to remove the second panel 96 in order to access to the exhaust components, e.g., the exhaust manifold 24, for servicing. Although the cover 90 may include one or more holes or apertures, the cover 90 may be substantially closed, meaning that the cover 90 does not include any vents or other structures for promoting significant air flow from the cover. For example, the planar faces of the first panel 98 and the second panel 96 are solid with out any air outlets or vents.

With reference to FIG. 3, the exhaust enclosure system 40 may include one or more modules or segments of the inner insulation assembly 42 and the cover 90. For example, the inner insulation assembly 42 may be formed from one or more modules, and the cover 90 may be formed from one or more cover segments, as will now be discussed.

The inner insulation assembly 42 may include a plurality of modules arranged axially along the exhaust manifold 24, e.g., along the outlet pipe of the exhaust manifold 24. Each module includes the layers of the inner insulation assembly 42 corresponding to that portion of the inner insulation assembly 42 extending along the exhaust manifold 24. The plurality of modules may be substantially identical in shape and composition. Each module may be arranged longitudinally end-to-end so that one module abuts another without overlapping. For example, the inner insulation assembly 42 may include a first module 110*a* longitudinally adjacent to and longitudinally abutting a second module 110*b* along an interface 118. The first layer 50, the second layer 70, and the third layer 80 of the first module 110*a* may longitudinally abut a corresponding first layer, second layer, and third layer of the second module 110*b*. The interface 118 may be configured such that the inner insulation assembly 42 is substantially seamless, that is, the first module 110*a* abuts the second module 110*b* without any gap or overlap. The first module 110A may be coupled to the second module 110*b* using one or more attachment elements 88, such as, e.g., spring and hook assemblies. The seamless modules (110*a*, 110*b*) may reduce convection or radiation of heat from the exhaust manifold 24. Each module may be configured to be individually removed, added, or replaced without disturbing the other modules. In some examples, the modules (110*a*, 110*b*) of the inner insulation assembly 42 may correspond to the sections of the exhaust manifold 24. For example, the interface 118 between modules of the inner insulation assembly 42 may axially align with the connection between flanges 34 of sections of the exhaust manifold 24.

The cover 90 of the exhaust enclosure system 40 may be segmented into a series of cover segments, e.g., a first cover segment 128 and a second cover segment 122, arranged along the exhaust enclosure system 40. Each cover segment (128, 122) may be arranged to longitudinally abut another cover segment. For example, the first cover segment 128 may longitudinally abut the second cover segment 122. Each cover segment may be configured to be individually removed or added without disturbing the other cover segments. The exhaust enclosure system 40 may include strips 124 or bands over the interface between the cover segments (128, 122). The strips 124 may be removably coupled to the cover segments (128, 122) by one or more fasteners 102. While strips 124 are not shown connecting the first panel 98 of cover segment 128 to an adjacent cover segment circumferentially enclosing module 110*a* of the exhaust enclosure system, it is understood that such strips 124 may be included to join the first panel 98 of cover segment 128 to another similar cover segment that circumferentially surrounds module 110*a*.

INDUSTRIAL APPLICABILITY

The exhaust enclosure system 40 disclosed herein may be applied to any internal combustion engine 2 where thermal isolation of exhaust components is desired. For example, the exhaust enclosure system 40 may be implemented to isolate the thermal load of the exhaust components produced during engine 2 operation. In an exemplary embodiment, the exhaust enclosure system 40 may be implemented in a marine engine application, e.g., to comply with thermal regulations. The disclosed exhaust enclosure system 40 may help to reduce or contain the thermal energy emitted from exhaust components of the engine 2.

During operation, combustion in the engine 2 releases hot exhaust gases into the exhaust manifold 24 and through the turbine 20, which in turn convey heat to the surrounding area. The exhaust enclosure system 40 may contain the heat thereby reducing the temperature of the outermost surface of the exhaust components, protecting other engine components from excessive thermal load, and providing a safer area for operators. The exemplary exhaust enclosure system 40 may include a inner insulation assembly 42 circumferentially surrounding the exhaust manifold 42. The inner insulation assembly 42 may include a first layer 50 in direct contact with the exhaust manifold, e.g., at one or more flanges 34 of the exhaust manifold 24. The inner insulation assembly 42 may further include a second layer 70 circumferentially surrounding the first layer 50, and a third layer 80 circumferentially surrounding the second layer 70. The inner insulation assembly 42 may insulate the exhaust manifold 24, thereby reducing the amount of heat released from the exhaust manifold 24 to the cover 90 via convection or radiation. In addition to insulating the exhaust manifold 24, protrusions 58 or wear pads 56 integrated in the first layer 50 may improve the durability of the exhaust enclosure system 40 and prolong its lifetime of use by absorbing forces exerted on the first layer 50 by the exhaust manifold 24, e.g., vibrations of the exhaust manifold 24. The air gap 46, formed between inner insulation assembly 42 and cover 90, may insulate the inner insulation assembly 42, and the exhaust manifold 24 therein, to further reduce heat transfer to the cover 90. The inner insulation assembly 42 and the cover 90 may isolate the heat emitted from the exhaust components such that the outer surface 94 of the cover 90 stays below a desired temperature during operation of the engine 2. For example, during operation of the engine 2, at steady state or otherwise, the cover 90 may have a outer surface temperature below about 220° C.

Modularity of the exhaust enclosure system 40, e.g., the modules (110*a*, 110*b*) of the inner insulation assembly 42, as well as separation of parts of the inner insulation assembly 42 and segmentation of cover 90, may improve serviceability of the exhaust enclosure system 40 and the exhaust components contained therein. Because each module (110*a*, 110*b*) is individually removable, the number of components that must be removed for service may be reduced. Further, each module (110*a*, 110*b*) may be replaced independently, lowering costs of repairs. Similarly, the individual removal of each cover segment (128, 122) may further improve serviceability of the exhaust enclosure system 40 and the exhaust components.

It will be apparent to those skilled in the art that various modifications and variations can be made to the disclosed device without departing from the scope of the disclosure. Other embodiments of the disclosure will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A exhaust enclosure system for use with an outlet pipe of an engine exhaust manifold, the system comprising:

an inner insulation assembly circumferentially surrounding at least a portion of the outlet pipe, the inner insulation assembly including a plurality of modules, each module comprising:

a first layer in direct contact with the outlet pipe, and a second layer fixed to the first layer and having different insulation properties than the first layer, each module further comprising a first circumferential part and a second circumferential part, and the first circumferential part being disposed adjacent the second circumferential part to circumferentially surround a portion of the outlet pipe;

a plurality of attachment elements configured to releasably secure together each first circumferential part of each module to the second circumferential part of the module;

a cover enclosing the plurality of modules of the inner insulation assembly, the cover including a plurality of individual cover segments; and an air gap positioned between each of the plurality of modules of the inner insulation assembly and an adjacent cover segment.

2. The exhaust enclosure system of claim 1, wherein the inner insulation assembly includes a plurality of projections in direct contact with the outlet pipe of the engine exhaust manifold, and portions of the inner insulation assembly between the projections are not in contact with the outlet pipe.

3. The exhaust enclosure system of claim 2, wherein the outlet pipe includes multiple tubular segments with a radial flange at each end, and the plurality of projections are in direct contact with flanges.

4. The exhaust enclosure system of claim 3, wherein the plurality of projections are spaced from the outlet pipe in sections of the outlet pipe between the flanges, thereby forming a plurality of circumferential air pockets between the flanges of the outlet pipe.

5. The exhaust enclosure system of claim 4, wherein the circumferential air pockets fluidly connect to one another between the plurality of flanges.

6. The exhaust enclosure system of claim 2, wherein the plurality of projections include a plurality of wear pads positioned at an end of each of the plurality of projections and facing the outlet pipe.

7. The exhaust enclosure system of claim 1, wherein the inner insulation assembly includes a plurality of separate modules positioned to abut but not overlap each other.

8. The exhaust enclosure system of claim 1, wherein the cover comprises carbon steel.

9. The exhaust enclosure system of claim 1, wherein the cover is substantially closed.

10. The exhaust enclosure system of claim 1, wherein each module longitudinally abuts an adjacent one of the modules.

11. The exhaust enclosure system of claim 10, further comprising a plurality of longitudinal attachment elements configured to releasably secure together adjacent modules.

12. An exhaust enclosure system, comprising:

an inner insulation assembly circumferentially surrounding an outlet pipe of an engine exhaust manifold, the inner insulation assembly including:

a first layer circumferentially surrounding the outlet pipe, the first layer including a plurality of wear portions in direct contact with the outlet pipe, a second layer circumferentially surrounding the first layer, and a third layer circumferentially surrounding the second layer, wherein the second layer is different and thicker than the first and third layers, and the second layer includes insulating material;

a cover enclosing the inner insulation assembly; and an air gap circumferentially between the cover and the inner insulation assembly.

13. The exhaust enclosure system of claim 12, wherein the cover is substantially closed.

14. The exhaust enclosure system of claim 12, wherein the exhaust manifold includes multiple tubular segments with a radial flange at each end, and wherein the first layer contacts the exhaust manifold at a periphery of the flanges.

15. The exhaust enclosure system of claim 14, wherein the first layer does not contact the outlet pipe between the plurality of flanges.

16. The exhaust enclosure system of claim 14, wherein the first layer includes a plurality of projections extending radially inward toward the flanges, and wherein the first layer contacts the periphery of the flanges at an end of each of the plurality of projections.

17. The exhaust enclosure system of claim 12, wherein the plurality of wear portions include a plurality of wear pads positioned about the plurality of wear portions and facing the outlet pipe.

18. The exhaust enclosure system of claim 12, wherein the second layer comprises silica batting.

19. An exhaust enclosure system, comprising:

an inner insulation assembly circumferentially surrounding an outlet pipe of an engine exhaust manifold, the inner insulation assembly including a plurality of modules, each module comprising:

a first layer in direct contact with the outlet pipe of the exhaust manifold, and a second layer fixed to the first layer and having different insulation properties than the first layer, a cover enclosing the plurality of modules of the inner insulation assembly, the cover including a plurality of individual cover segments; and an air gap positioned between each of the plurality of modules of the inner insulation assembly and an adjacent cover segment.

20. The modular exhaust enclosure system of claim 19, wherein each module is configured to be added or removed from the exhaust enclosure system without removing any of the other modules.

21. The modular exhaust enclosure system of claim 19, wherein each of the plurality of modules includes a first circumferential part and a second circumferential part, and the first circumferential part is disposed adjacent to the second circumferential part to circumferentially surround a portion of the outlet pipe.

22. The modular exhaust enclosure system of claim 19, wherein each cover segment is configured to be added or removed from the exhaust enclosure system without removing any of the other cover segments.

* * * * *